US006733150B1

(12) United States Patent
Hanley

(10) Patent No.: US 6,733,150 B1
(45) Date of Patent: May 11, 2004

(54) HEADGEAR WITH FORWARD ILLUMINATION

(76) Inventor: Edward B. Hanley, 3938 Belmore Way, Reno, NV (US) 89503

( * ) Notice: Subject to any disclaimer, the term of this patent is extended or adjusted under 35 U.S.C. 154(b) by 14 days.

(21) Appl. No.: 10/126,906

(22) Filed: Apr. 19, 2002

Related U.S. Application Data

(60) Provisional application No. 60/285,401, filed on Apr. 20, 2001.

(51) Int. Cl.[7] ..... F21V 21/084

(52) U.S. Cl. ..... 362/106; 362/105; 362/231; 362/800; 2/209.13

(58) Field of Search ..... 362/103, 105, 362/106, 231, 234, 800; 2/209.13

(56) References Cited

U.S. PATENT DOCUMENTS

| | | | | |
|---|---|---|---|---|
| 1,187,672 A | | 6/1916 | Stiefvater | |
| 5,357,409 A | | 10/1994 | Glatt | 362/249 |
| 5,485,358 A | | 1/1996 | Chien | 362/106 |
| 5,510,961 A | | 4/1996 | Peng | 362/106 |
| 5,667,292 A | | 9/1997 | Sabalvaro, Jr. | 362/106 |
| 5,758,947 A | | 6/1998 | Glatt | 362/105 |
| 6,044,495 A | | 4/2000 | Ellman et al. | 2/195.1 |
| 6,390,640 B1 | * | 5/2002 | Wong et al. | 362/105 |

* cited by examiner

*Primary Examiner*—Stephen F. Husar
(74) *Attorney, Agent, or Firm*—Sierra Patent Group, Ltd.

(57) ABSTRACT

The disclosed device is directed towards an illumination headgear. The illumination headgear comprises a crown having a lower edge. A brim is disposed on the crown proximate to the lower edge. The brim has a rim disposed along the perimeter of the brim distal from the lower edge. An array of contiguous light emitting diodes is integral within the brim and proximate to said rim. The array of contiguous light emitting diodes is focused to form a contiguous beam.

31 Claims, 15 Drawing Sheets

HEADGEAR WITH FORWARD ILLUMINATION

CROSS-REFERENCE TO RELATED APPLICATION

This application claims priority from provisional application Ser. No. 60/285,401, filed Apr. 20, 2001.

FIELD OF THE INVENTION

The disclosure relates to the field of illuminated headgear, in particular, headgear that feature high intensity illumination mounted in the headgear providing general purpose illumination by which the user can see in dark places.

DESCRIPTION OF RELATED ART

There is a wide variety of illuminated headgear and illumination sources that can be mounted on headgear worn by the user. Many of these types of headgear provide light that is meant to be seen by others rather than providing light for the user to see by. Many lighted headgear in this category are of a novelty or decorative type. Others are used to warn other people of the presence of the user. These type of inventions generally used low intensity or widely arrayed types of illumination. For example U.S. Pat. No. 5,485,358 issued to Chen teaches LED lights disposed at the rear and on the sides of a baseball cap, providing a light to be seen by others to alert them to the presence of the wearer; U.S. Pat. No. 5,758,947 issued to T. L. Glatt teaches a safety helmet with LEDs arrayed around the outward lower edge and containing circuitry to flash the LEDs in a sequential manner so as to alert others to the presence of the wearer; U.S. Pat. No. 5,510,961 teaches a novelty hat with lights disposed around the edge of the brim with a sound recording and a battery source in the brim, having circuitry to flash the lights to provide a novelty flickering effect accompanied by sound.

Another body of illuminated headgear helps focus a light source in the direction the user is facing so as to provide illumination for the benefit of the user to see by, e.g. illuminating books being held and read by the user, illuminating objects held by the user, illuminating an area that the user is working or operating in, and so on. In general these inventions are very specialized with emphasis on the availability of a light source, and only approximate the normal appearance and utility of common headgear, or are additions to common headgear. For example U.S. Pat. No. 6,044,495 issued to Ellman et. al. teaches a detachable visor cover which slides into place on top of a baseball cap visor, on the top portion of which is mounted a light source for runners or bicyclists to see at night; U.S. Pat. No. 5,667,292 issued to Sabalvaro utilizes a topless hat or visor with a pivot mounted light source that can direct the light forward and above the brim; U.S. Pat. No. 1,187,672 issued to Stiefvater teaches a visor-mounted light bulb and battery source with a light bulb housing which incorporates an eye shield placed at the edge of the brim angled downward, as for reading.

The problem with prior art devices is that they are bulky, stand out visually so as to detract from the general aesthetics of normal headgear, may employ filament light bulbs which wear out and require a means for replacement, or are detachable from the headgear so they could be left behind and not available when needed.

There remains the need for a general purpose illuminating device integral to many kinds of common headgear which have their own intrinsic utility and aesthetic characteristics, to which the illuminating device would add the utility of a hands free light source for the benefit of the user to see by, such illuminating device being light enough in weight and visually inconspicuous enough that it does not significantly alter the headgear's intrinsic utility or aesthetics. In addition there remains a need for such a headgear mounted illuminating device that is durable and reliable, which would not require replacement of the light source.

SUMMARY OF THE DISCLOSURE

The disclosed device is directed towards an illumination headgear. The illumination headgear comprises a crown having a lower edge. A brim is disposed on the crown proximate to the lower edge. The brim has a rim disposed along the perimeter of the brim distal from the lower edge. An array of contiguous light emitting diodes is integral within the brim and proximate to said rim. The array of contiguous light emitting diodes is focused to form a contiguous beam.

DETAILED DESCRIPTION

Figure 1:
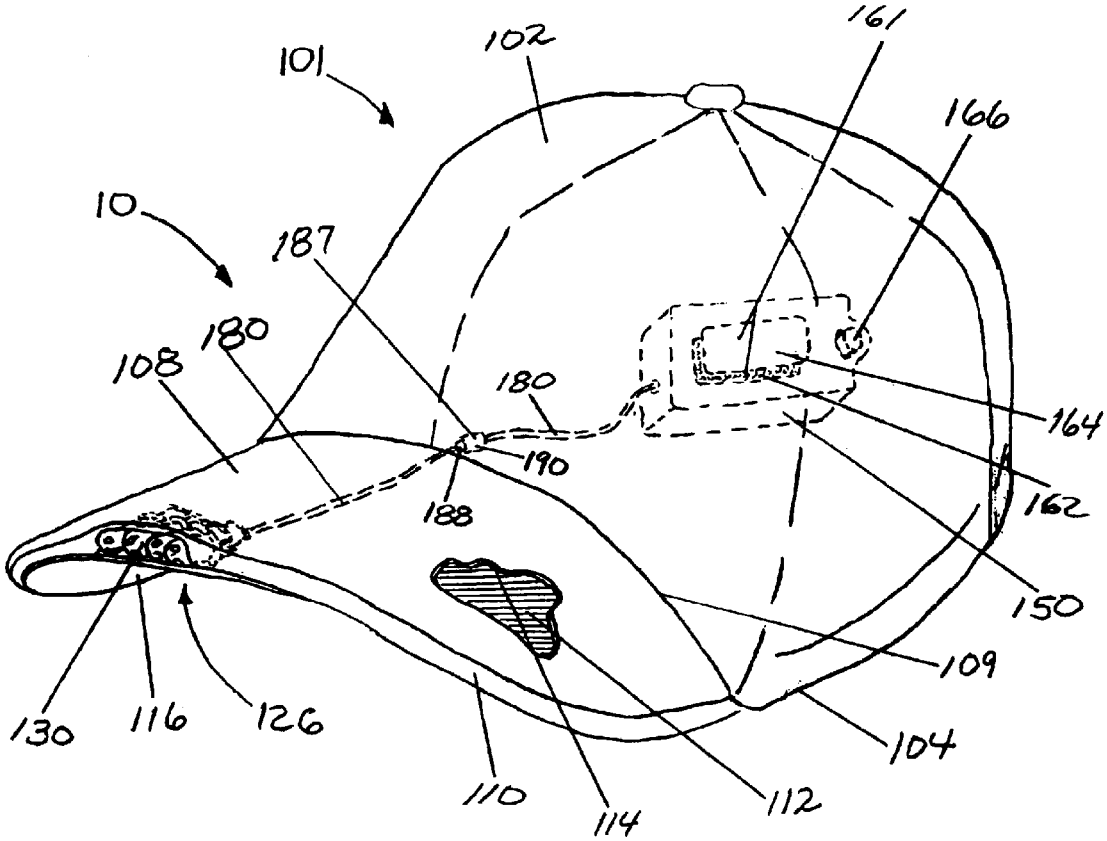
FIG. 1 is a perspective view of an exemplary embodiment of the illumination headgear in the form of a ball cap.

Referring to the drawings and particularly to FIGS. 1 through 6, there is illustrated an illumination headgear, generally designated as 10, in an exemplary embodiment of a ball cap.

Referring to FIG. 1, the ball cap 101 generally comprises a crown 102 contoured for covering a part of the user's head when worn, a brim 108 disposed exteriorly of and attached to the crown 102 at a lower edge 104 such that the brim 108 extends outwardly from the crown 102. The brim 108 is a member of the ball cap generally worn such that it is most proximal to the forehead of the user and extends distally from the forehead of the user. The brim 108 comprises a main panel 112 which is flexible but stiffer than the top cover sheet 114 and bottom cover sheet 116 which attach to the upper and lower surfaces of the main panel 112 by means of stitching, adhesive, or the like (not shown). The brim 108 has a rim 110 which comprises the most distal limits of the brim 108 extending away from the juncture 109 whereat the brim 108 joins the lower edge of the crown 104. The brim has a thickness which is essentially the sum of the thicknesses of the components of which it comprises, i.e. the main panel 112, the top cover sheet 114 and the bottom cover sheet 116.

The main components which essentially comprise the illumination device 126 as disposed within the illumination headgear are a light source 130, a power supply 150 to provide electrical energy to the light source, an electrical conducting path 180 along which electrical energy can flow, and a switch 166 to control the flow of electrical energy to the light source 130.

The light source 130 of the exemplary embodiment comprises one or more high intensity light emitting diodes (LED) that radiate light in a broad spectrum so as to appear white to the human eye. The light emitting diodes can be aligned relative to each other in such a way as to project a beam of light. The beam of light can be contiguous, non-segmented or in a substantially conical shape either fanned out or oval shaped and the like. The beam has no dark areas. The LEDs can be parallel to each other or aligned such that the light emitted forms a contiguous pool of light that washes the objects that are illuminated by the beam. For example, the lens of the LED can be configured for 40 degrees, that is, the lens emits a cone of light that spreads out at angles to about 20 degrees to each side of a central axis of the cone. If there are at least two LEDs aligned, then the LEDs can emit light fanned out to about 40 degrees from each other and maintain a beam with a continuous pool of light. One example of a white LED is Model No. NSPW500BS manufactured by Nichia Corporation of Japan. In general LEDs vary in size, color output, and manufacturer. The illumination headgear is intended to allow modification so as to incorporate any and all LEDs of whatever size, shape and color output, which can be incorporated into the illumination headgear within the broadest parameters of its design and purpose. Some advantages of LEDs as a light source are durability because they have no filament and are thus much less susceptible to mechanical damage than filament-containing bulbs; relatively cool operation because a filament is not heated to produce light; claimed longevity of 100,000 hours of operation thus obviating the need for replacement and permitting permanent mounting for the life of some products; high light output with low current drain compared to filament-containing bulbs, such that light output equal to or greater than that of a common handheld flashlight can be achieved, and for a longer period of time than with filament bulbs using a similar power source; small power sources such standard "AAA" size batteries or watch batteries can be used; miniature size and light weight; and a relatively even distribution of light across the illuminated field due to incorporation of a light-distributing lens within their design. The illumination headgear takes advantage of all these features to overcome some limitations of prior art.

A light emitting diode in a standard configuration comprises a silicon chip doped with varying combinations of atoms such as indium, gallium, phosphorous, and so on, such that when a voltage is placed across the chip photons of light are emitted, the wavelength of the photons being determined by the doping elements within the silicon chip. The chip is encased within a pellucid substance such as epoxy which is molded to a rounded shape, which roundness is designed to act as a lens to control the shape and distribution of the emitted light.

Figure 2:
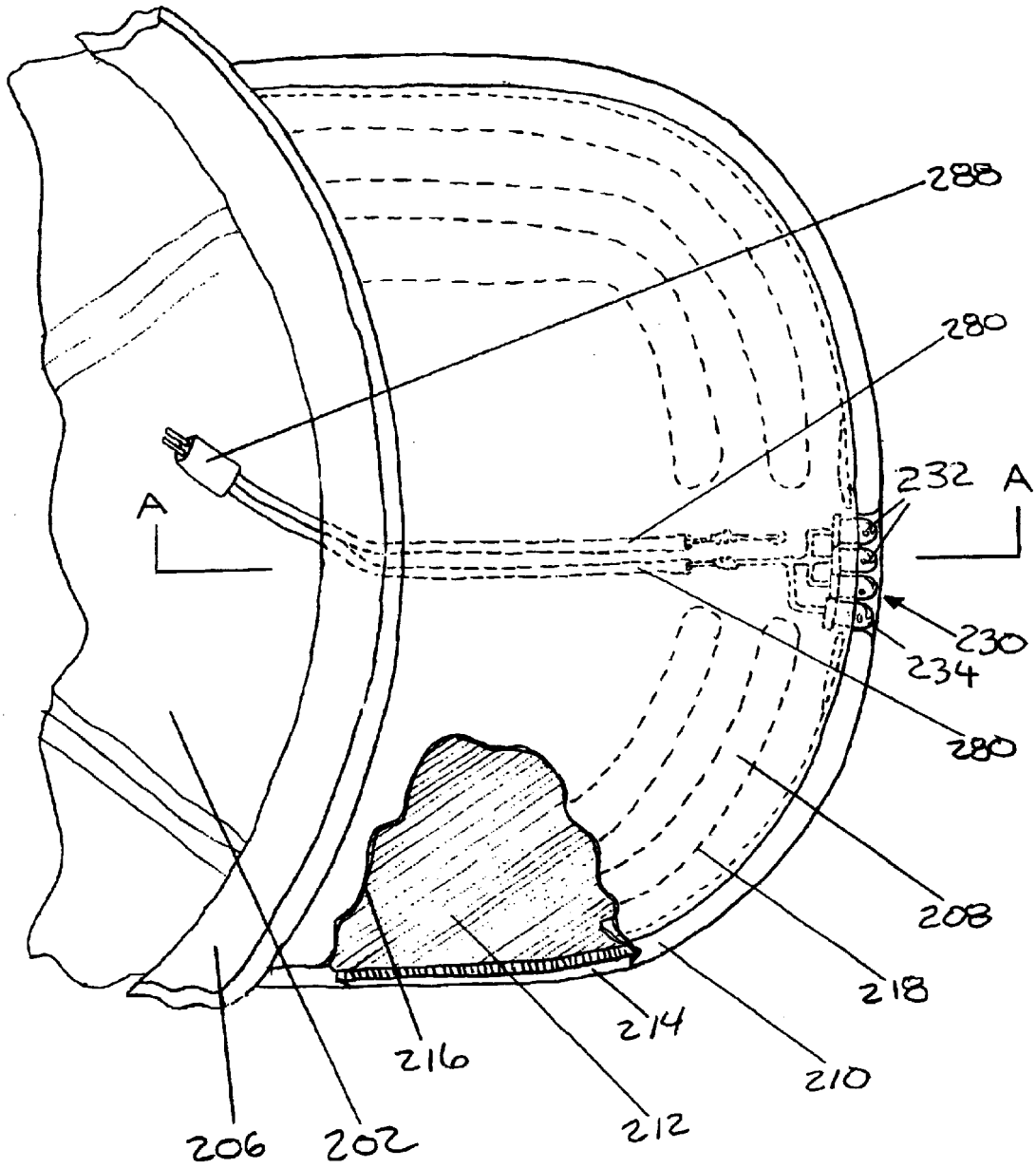
FIG. 2 is a plan view of the underside of the brim of the ball cap in FIG. 1.

Referring to and FIG. 2, a light source formed by an array of contiguous light emitting diodes 230 comprising of one or more LED's 232 is integrally disposed within the brim at the rim in such a way that the forwardmost part of the lens 234 of the LEDs 232 is more or less even with the rim 210 of the brim 208. The lens may extend beyond the rim 210 or be contained totally interior to the rim 210 according to desired parameters of utility and aesthetics. The LEDs 232 are positioned within the brim 208 in such a way that when the user is wearing the headgear with the brim 208 positioned forward, the light is directed more or less along the line of sight of the user, so as to illuminate an area generally forward or in front of the user, or to illuminate an area in whatever direction the user is facing by turning the head. There is generally illustrated in this disclosure a method of manufacture of the illumination headgear, and specifically the method of disposing the light source 230 in the rim 210 of the brim 208. The brim generally comprises a main panel 212 which is flexible but stiffer than and thicker than the top cover sheet 214 and the bottom cover sheet 216. The light source 230 and the electrical conducting path 280 are integrally disposed within the main panel 212 by means of being molded into the main panel 212 or fitted into a void in the main panel and held in place by adhesive, stitching 218, or the like. The electrical conducting path 280 passes between the sweatband 206 and the crown 202 to emerge interiorly to the crown 202 where it is terminated by an electrical connector 288, by which it is further connected to a power supply (not shown). The top cover sheet 214 and bottom cover sheet 216 totally enclose the main panel 212 except for an opening through which the forward portion of the light source 230 projects. As the light source is forward of the eyes of the user and the eyes are shielded from the emitted light by the bottom cover sheet 216, the user is not distracted by glare from the light source. In order that the user may see whether the light source is on or off, the bottom cover sheet 216 may incorporate a translucent component (not shown) directly covering the light source 230 through which some light may be seen, such that an upward glance toward the translucent component will signal to the user whether the light is ON or OFF. This would be especially useful in the locations that have ambient light.

Figure 3:
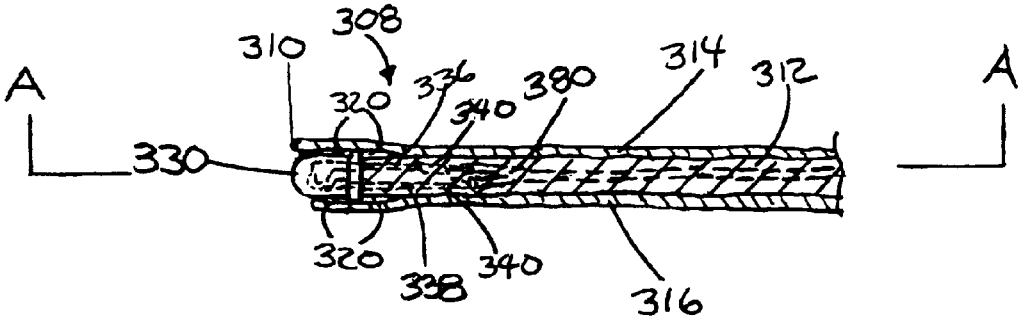
FIG. 3 is an enlarged cross-sectional view taken across A—A in FIG. 2 showing an exemplary embodiment of the method of permanently mounting the light source.

Referring to FIG. 3 the light source 330 and the electrical conducting path 380 are mechanically and integrally disposed at the rim 310 of the brim 308 by means of being molded into the material which comprises the main panel 312 of the brim 308. Alternatively the light source 330 and the electrical conducting path 380 are mounted to a pre-existing main panel 312 within voids such as cutouts, grooves, or the like (not shown), and secured with stitching, adhesive, or the like. The positive lead 338 and negative lead 336 are secured by electromechanical connections 340 to the electrical conducting path 380, in this instance but not necessarily a two-conductor wire. The portions of the top cover sheet 314 and the bottom cover sheet 316 not held in place by stitching 318 (not shown) are attached with adhesive 320.

Figure 4:
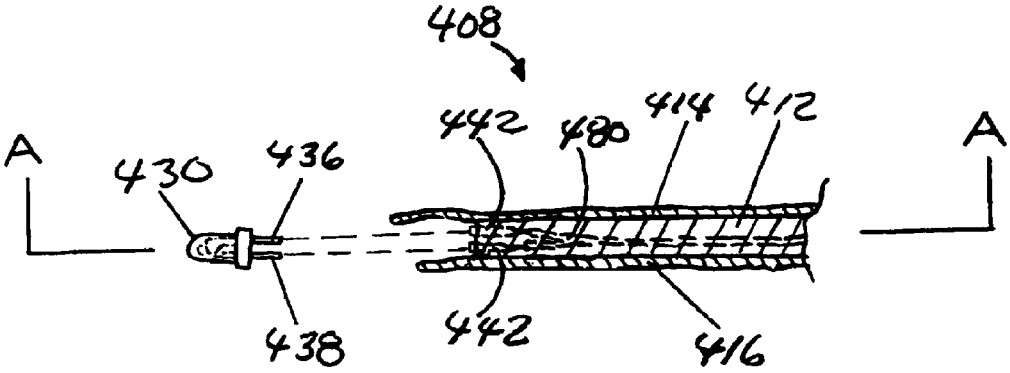
FIG. 4 is an enlarged cross-sectional view taken across A—A in FIG. 2 showing an alternative embodiment of a method of detachably mounting the light source.

Referring to FIG. 4 a method for detachably mounting the light source 430 is illustrated. A void is made in the main panel 412 of the brim 408 so as to accommodate the insertion of a light source 430. The negative and positive leads 436, 438 insert into and are mechanically held by female plugs 442 attached to the conductive path 480. This method of detachably mounting the light source 430 allows for the substitution of LED's of differing qualities to suit specific purposes. E.g. red LEDs may be used to preserve night vision; ultraviolet LEDs may be inserted to allow the user to see substances that fluoresce under ultraviolet light, such as but not limited to certain minerals, fluorescent inks or paint, spotting of carpets due to spraying or urination of pets, and certain creatures with UV fluorescent pigments or body parts; infrared LEDs may be used to provide a light source for infrared-activated night spotting scopes. Blue, green and yellow LEDs may also be employed for uses that take advantage of their qualities. Light sources of different sizes can fit between the flexible top cover sheet 414 and bottom cover sheet 416.

Figure 5:
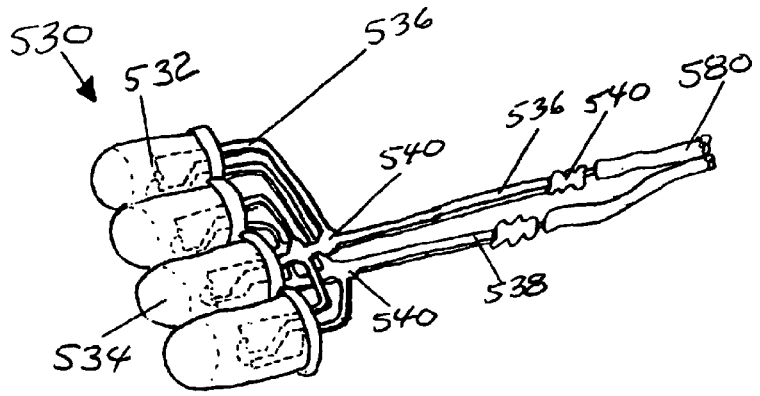
FIG. 5 is a close-up perspective view of an electrically parallel array of LED's.

Referring to FIG. 5, there is illustrated a light source 530 which comprises a number of LED's 532 joined at electromechanical connections 540 such as solder, a weldment or the like, so as to be electrically parallel with each other and supported relative to each other by the electromechanical connections 540 joining the negative leads 536 and positive leads 538 of each LED 532. When a voltage is placed across the leads 536 and 538, light is emitted through and focused by the lens 534 of each and every LED 532. There is further illustrated a typical connection of the negative lead 536 and positive lead 538 of the light source 530 to the electrical conducting path 580 by means of electromechanical connections 540.

Figure 6:
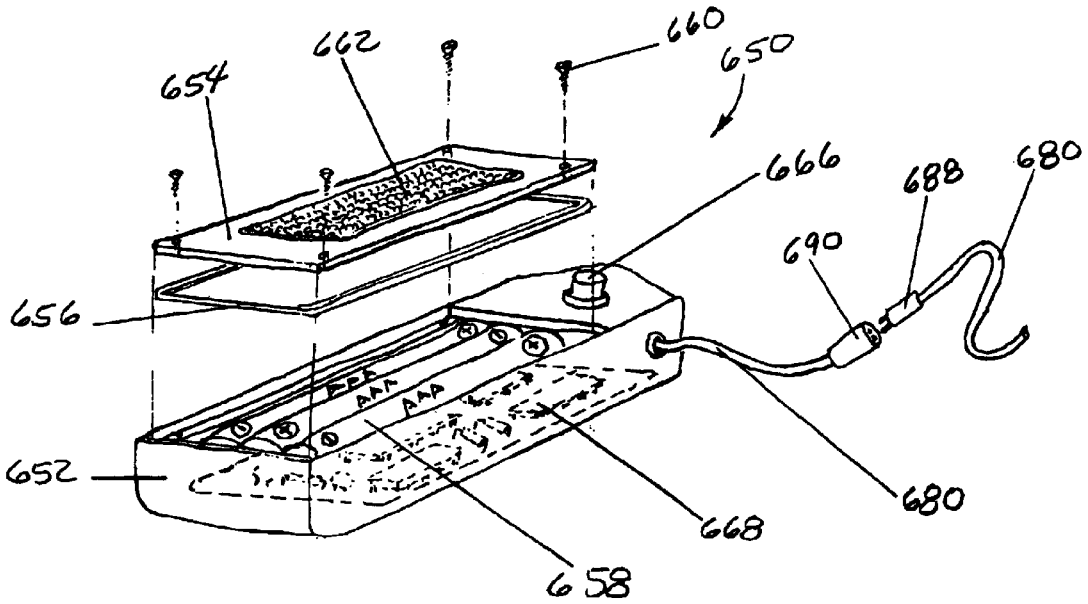
FIG. 6 is a perspective view of a power supply and a switch.

Referring to FIG. 6, the power supply 650 comprises a case 652 with a moveable or removable component 654 permitting access to the batteries 658 or other power source contained therein. The moveable or removable component of the case 654 is attached to the main body of the case 652 by means of screws 660 or other attachment method. A compressible gasket 656 is inserted to prevent moisture and liquid from leaking into or out of the case. If electronic control of the current directed to the light source 630 (not shown) is desired for purposes of strobing, pulsing, flashing, or varying the intensity of the light source 630 (not shown), a circuit board 668 holding the components to accomplish the electronic control is contained within the power supply. A switch 666 is attached to the case in such a manner that it can be manipulated through the flexible material comprising the crown of the ball cap FIG. 1, 102, or other means of activating the switch. The switch 666 may be a mechanical single-pole-single-throw, push-on-push-off switch, to place the light source FIG. 1, 130 in an ON or OFF state. Alternatively the switch may be more complex such as rotary, incorporating a lever, or electronically activated using electronic components on the circuit board 668, in order to allow the user to exercise more complex control over the light output such as flashing, strobing, pulsing or varying the intensity, or switching between different types of LEDs incorporated into the light source FIG. 1, 130. Electrical energy passes from the power supply 650 to the light source 630 (not shown) by means of an electrical conducting path 680 which is dismountably coupled to itself somewhere along its length by means of a two-component electrical connector, comprising in this example of a male plug 688 and a female receptacle 690, for the purposes of removal of the power supply 650 from the illumination headgear. One part 662 of a two-part fastener, such as hook and loop, is attached to the power supply 650 by means of which the power supply 650 is dismountably coupled to the interior of the crown of the illumination headgear.

The electrical current may also be switched or controlled by means of variously mounted sensors and electronic circuitry on circuit board 668 which turn on the light source in response to changes in the environment, such as absence of light, or by response to other than mechanical signals sent to the switching sensors and circuitry by the user, such as sound. Any level of sophistication or complexity may be used to activate the switch mechanism 666 using electronic sensors and circuitry. Examples would be voice recognition, thought-associated brain-wave pattern recognition, remote radio control, and so on.

Referring again to FIG. 1, The power supply 150 is demountably coupled interiorly to the crown 102 of the ball cap by means of a two-component fastener such as hook and loop, a clip, buttons, snaps, or the like. One fastener component, say, the hook component 162 is attached to the power supply 150 and the other fastener component, say, the loop component 164 is attached to the interior of the crown 102 in such a manner that when two fastener components are mated and the power supply 150 is in place, and the ball cap is being worn by the user, the switch 166 is positioned away from the user's head so that the user can conveniently reach and manipulate the switch 166 through the flexible material comprising the crown 102. The light source 130 receives electrical energy from a power supply 150 by means of an electrically conductive path 180, in this instance but not necessarily a two-conductor insulated wire. For convenience of changing or charging the batteries of the power supply 150, for washing the headgear, and other such convenience, the power supply is demountably coupled interiorly to the headgear, in this instance but not necessarily within the crown 102 portion of the ball cap, by means of a two-component fastener 161. Complete removal of the power supply 150 from the illumination headgear 10 requires that the electrical conducting path 180 is detachably coupled to itself by means of a two-component electrical connector 187 placed along the electrically conducting path 180. In this disclosure the two-component electrical connector 187 comprises a male plug 188 and a female receptacle 190. Any means of physically and electrically detachably coupling one portion of the electrically conductive path 180 to the other will suffice, as for example an electrically conductive path 180 comprising of conductive threads such as wire of carbon fiber or the like sewn into the fabric of the headgear can be detachably coupled to itself by means of a two-component electrical connector 187 such as a hook and loop fastener containing such electrically conductive threads.

Figure 7:
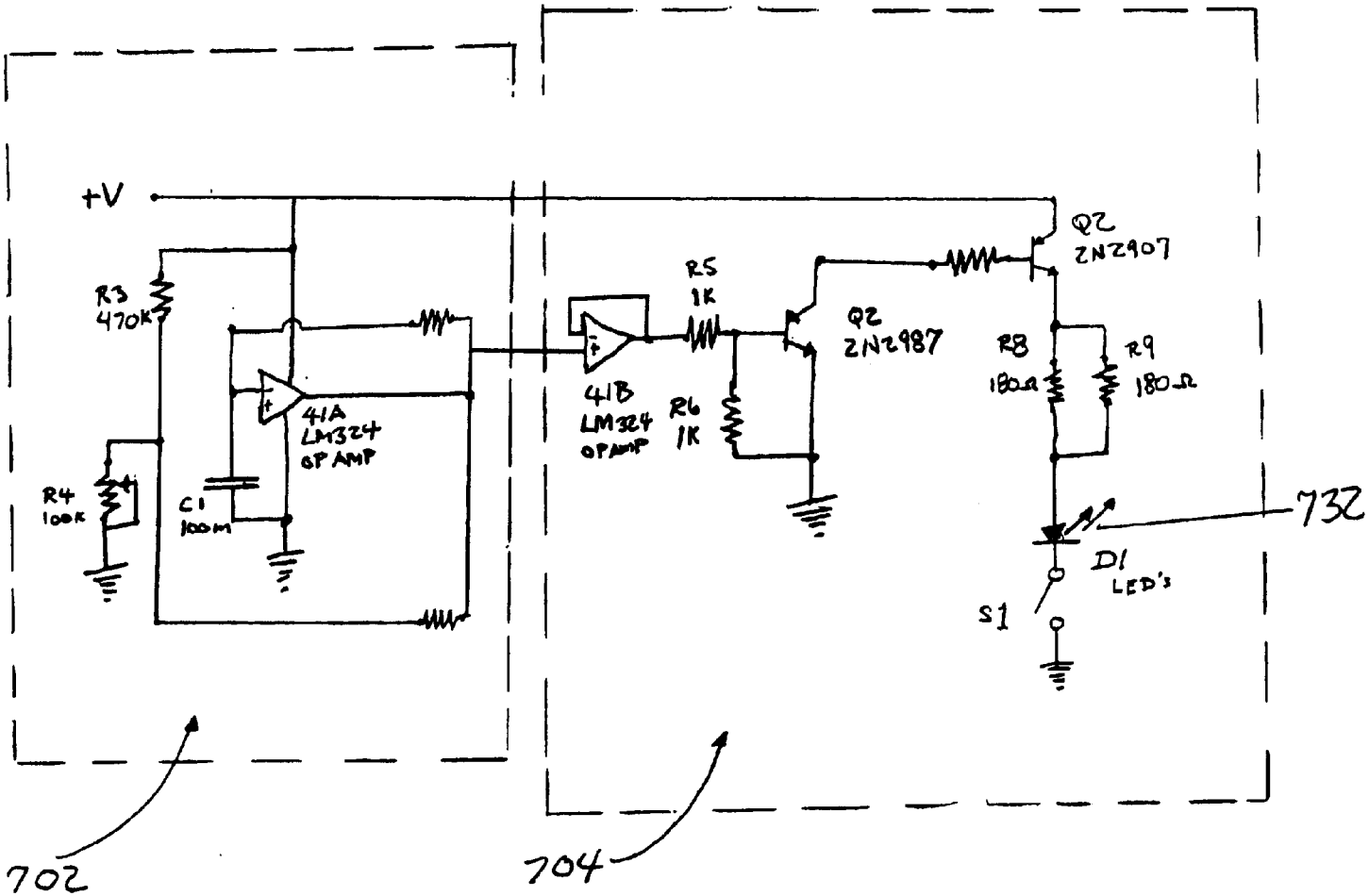
FIG. 7 PRIOR ART
FIG. 7 is a circuit schematic of prior art exemplary of a means of strobing the light source to produce greater apparent brightness and conserve power.

Referring to FIG. 7 there is illustrated an example of prior art which is a schematic diagram of a circuit which can be employed to strobe the light source for the purpose of increasing its apparent brightness and conserving power. The circuit performs the function of an oscillator 702 which generates a square wave, as well as the function of a switch 704 which turns on the LED(S) 732 at the leading edge of each square wave and turns off the LED(s) 732 at the trailing edge of each square wave. LEDs are rated to be used at a certain voltage, determined by the manufacturer, which provides the longest life for the component when it is used in a continuously ON manner. Generally an LED will emit a brighter light output at a voltage higher than the manufacturer's rated voltage, at the cost of decreasing the component's life due to heat from the higher current. The circuit disclosed here as prior art demonstrates one means of intermittently driving an LED (strobing) at a higher than rated voltage to produce a brighter light output, while allowing the LED to cool during the time it is turned off during each strobe cycle, generally preserving its rated life and conserving energy from the power source during the OFF portion of each cycle. When the LED 732 is strobed at a fast rate, the eye perceives the light output as steady rather than intermittent.

Figure 8:
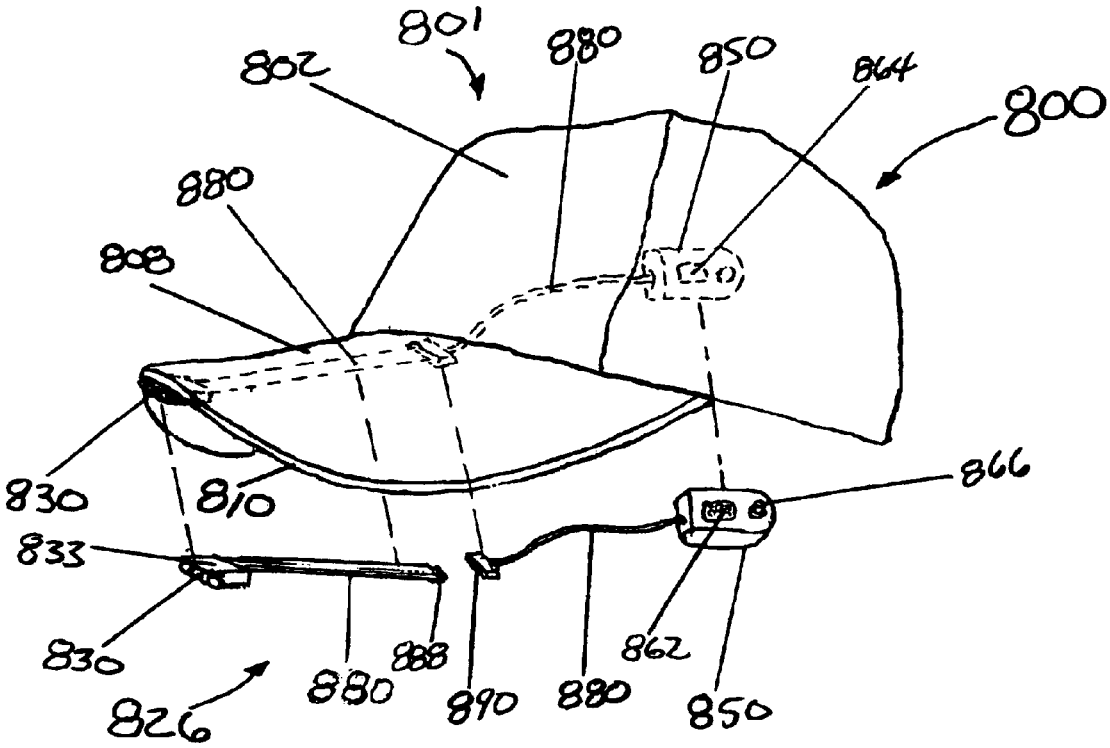
FIG. 8 is a perspective view of an illumination device mountable to a preexisting headgear.

Referring to FIG. 8, there is illustrated an embodiment of an illumination headgear 800 comprising a headgear 801, in this case but not necessarily a ball cap, to which is attached an illumination device 826. This method of manufacture allows conversion of a wide variety of pre-existing headgear to illumination headgear 800, in such a way that they retain their own utility and general aesthetic appearance while acquiring the additional utility of an illumination device 826. The illumination device 826 generally comprises a light source 830, an electrically conductive path 880, a power supply 850 and a switch 866. In this case the light source comprises one or more LEDs 832 contained within a housing 833, such as molded plastic, a fabric pocket, or the like, connected to an electrically conducting path 880, demountably coupled to itself by means of a male connector 888 and a female connector 890. The light source mounts under the brim 808, such as with adhesive, so that it is more or less even with the rim 810 of the brim 808. The electrically conductive path 880 has a thin, flat shape where it mounts to the underside of the brim, such as with adhesive. The male connector 888 comprises the terminating end of the flat portion of the electrically conductive path 880 which has the conductive portions exposed such that they slip into and make contact with the female connector 890. The power supply 850 is demountably coupled to the interior of the crown 802 by means of two fastener components 862, 864, such as hook and loop fasteners.

Figure 9:
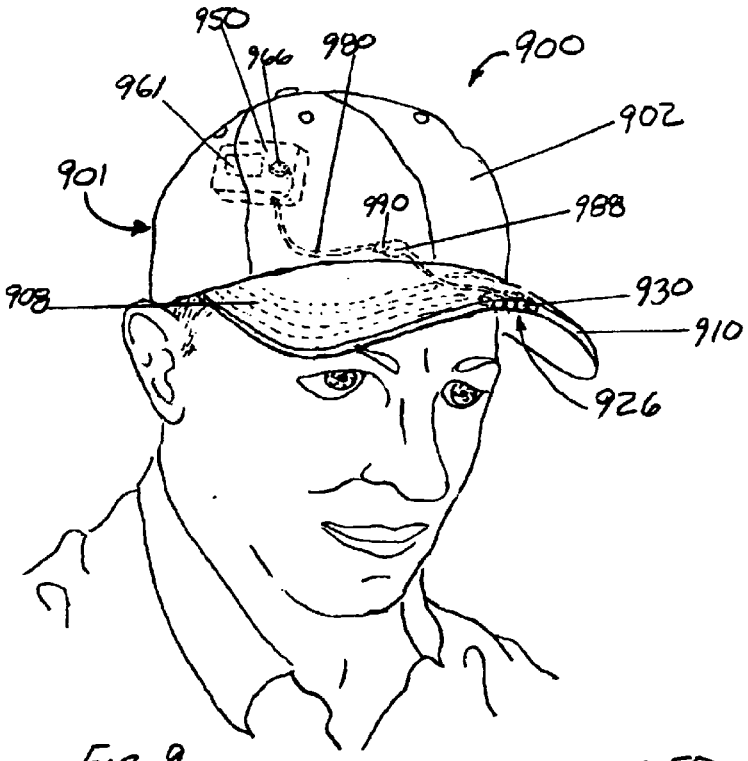
FIG. 9 is a perspective view of the illumination headgear as worn by the user.

Referring to FIG. 9, there is illustrated an exemplary embodiment of the illumination headgear 900 in the form of a ball cap showing its use as both a headgear 901 and as an illumination device 926. The headgear 901 generally comprises a crown 902 with an attached brim 908. A light source 930 is integrally disposed at the rim 910 of the brim 908, focused to form a contiguous beam. The light source 930 can be directed forward to illuminate the area generally forward of the user, or in whatever direction the user is facing by turning the head. An electrically conductive path 980 is disposed interiorly to the brim 908 to the point of its emergence from the brim to the interior space of the crown 902, where it is terminated with an electrical connector 988, such as a male plug. A counterpart electrical connector 990, such as a female plug, connects to an electrically conductive path 980 which connects to a power supply 950 detachably mounted interiorly to the crown 902, by means of a two-part connector 961 such as hook and loop, in such a manner that the switch 966 which controls the current flow between the power supply 950 and the light source 930 can be easily reached and manipulated through the flexible material comprising the crown 902.

Figure 10:
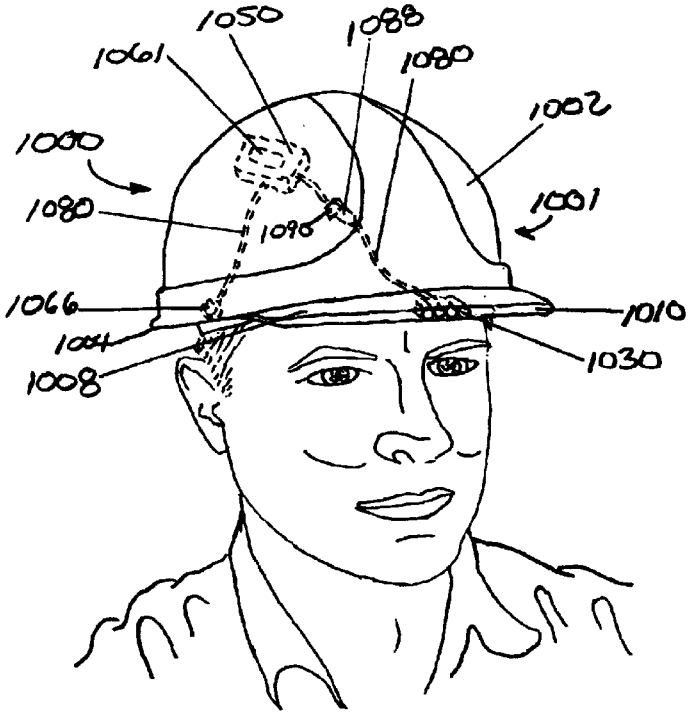
FIG. 10 is a perspective view of an exemplary embodiment of the illumination headgear in a construction hard hat.

Referring to FIG. 10, there is illustrated an exemplary embodiment of the illumination headgear 1000 in the form of a hard hat protective headgear 1001 such as is worn on construction sites, in mines, in caves, and so on, illustrating its use as both a protective headgear 1001 and as an illumination device. The protective headgear 1001 comprises a molded shell of some hard material such as plastic, fiberglass, or the like, integrating a crown covering portion 1002 and a brim 1008. A light source 1030 is integrally disposed interiorly to the brim 1008 along the forward portion of the rim 1010, directed forward to illuminate the area generally forward of the user, or in whatever direction the user is facing by turning the head. An electrically conductive path 1080 is likewise interiorly disposed within the brim and the crown covering portion 1002 to a point of emergence within the interior space of the crown covering portion 1002 where it is terminated with an electrical connector 1088, such as a male plug. The light source 1030 and conductive path 1080 are incorporated by being molded into the molded shell comprising the headgear 1001 during its construction, in such a way as to preserve the necessary strength and integrity of the headgear 1001. A counterpart electrical connector 1090, such as a female plug, connects to an electrically conductive path 1080 which connects to a power supply 1050 detachably mounted interiorly to the crown covering portion 1002 by means of a fastener 1061, such as hook and loop, a clip and receptacle, or the like. A switch 1066 which controls the current flow between the power supply 1050 and the light source 1030 is connected to the power supply 1050 with an electrically conductive path 1080. The switch 1066 is detachably mounted interiorly to the lower edge 1004 of the crown covering portion 1002 by means of a fastener, not shown, such as hook and loop, a clip, a bolt, a screw, or the like, in some position such that it is easily reached and manipulated by the user.

Figure 11:
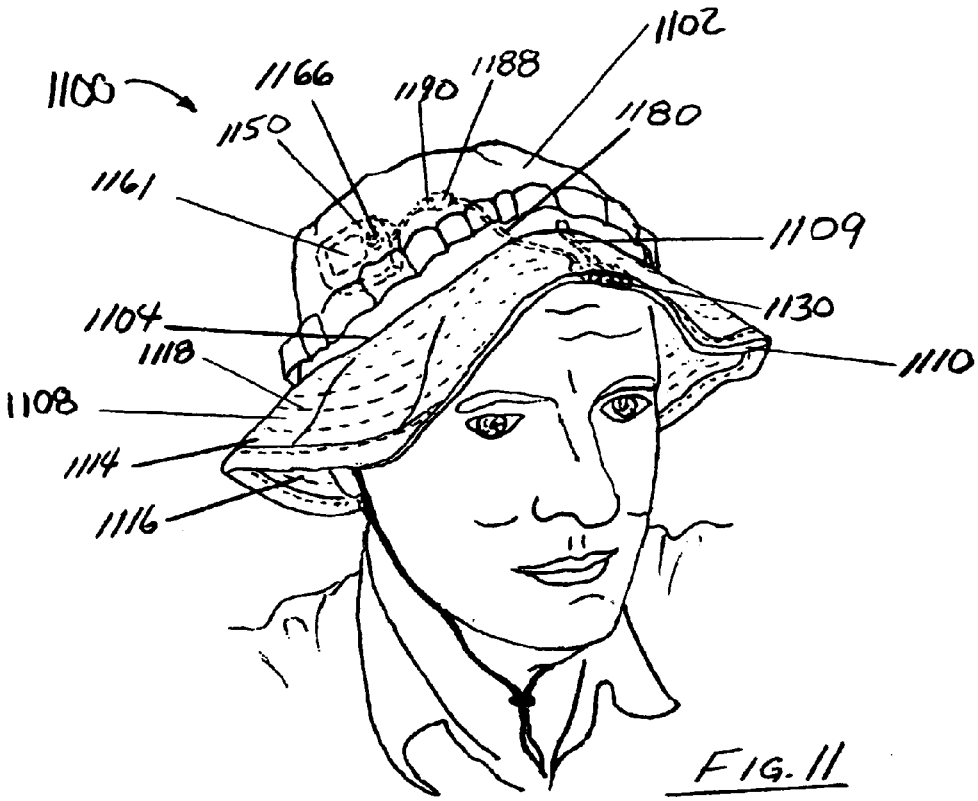
FIG. 11 is a perspective view of an exemplary embodiment of the illumination headgear in a military jungle hat.

Referring to FIG. 11, there is illustrated an exemplary embodiment of the illumination headgear 1100 in the form of a military jungle hat, illustrating its use in a class of headgear having a very flexible brim 1108. The headgear comprises a fabric crown 1102 having a fabric brim 1108 disposed exteriorly along the entire circumference of the lower edge of the crown 1104. A light source 1130 is integrally disposed along the forward rim 1110 of the brim 1108 such that it illuminates the area generally forward of the user, or in whatever direction the user is looking by turning the head. An electrical conducting path 1180 connects to the light source 1130 and is disposed interiorly to the brim 1108 between an upper layer of fabric 1114 and a lower layer of fabric 1116 which are held together with stitching 1118 to comprise the body of the brim 1108. The electrical conducting path 1180 emerges from the interior of the brim within the interior space of the crown 1102 where it is terminated with an electrical connector 1188, such as a male plug. This connector 1188 mounts with a counterpart connector 1190, such as a female plug, attached to an electrical conducting path 1180 which connects to a power supply 1150 and a switch 1166, such that electrical current can flow between the power supply 1150 and the light source 1130 to provide illumination under control of the switch 1166. The power supply 1150 and switch 1166 are demountably coupled interiorly to the crown 1102 by means of a two-component fastener 1161 such as hook and loop, a clip, or the like, in such a way that the switch 1166 faces outward from the user's head so that it can be conveniently manipulated through the flexible fabric comprising the crown 1102. A stiffener 1109 composed of some flexible material which maintains its shape when bent, such as metal wire of the like, is interiorly disposed to the brim 1108 generally between the light source 1130 and the lower edge of the crown 1104, and optionally interior to the rim 1110 (not shown), to allow for flexible adjustment of the brim 1108 near the light source 1130 to maintain a certain direction of the light with respect to the eye.

Figure 12:
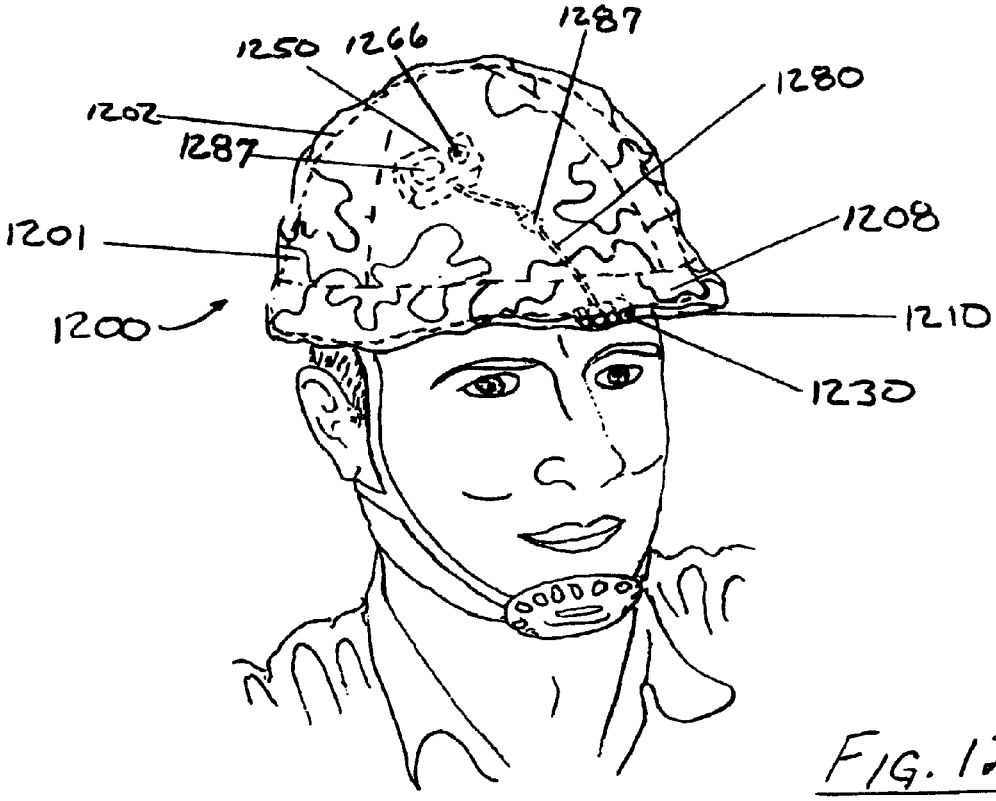
FIG. 12 is a perspective view of an exemplary embodiment of the illumination headgear incorporated within the cloth camouflage cover of a military helmet.
Figure 19:
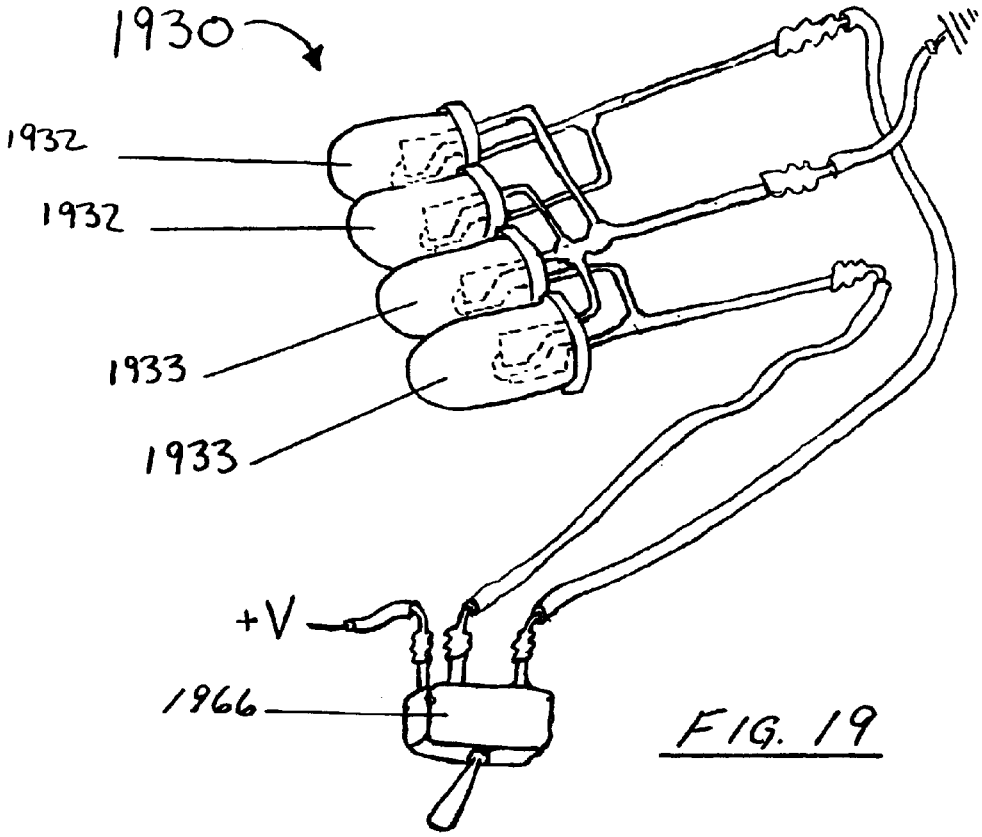
FIG. 19 is a close-up perspective view of a light source comprised of two sets of LED's, each set emitting a different quality of light, integrally mounted to each other, with a switch.
Figure 20:
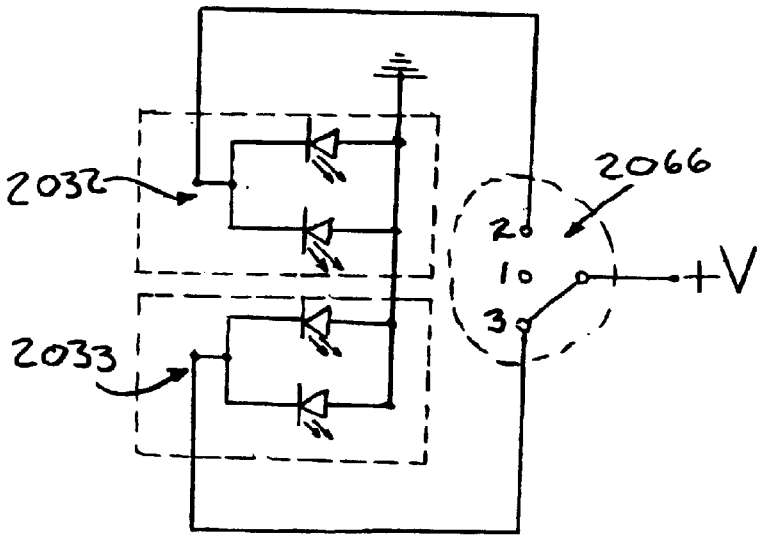
FIG. 20 is a circuit schematic of the light source depicted in FIG. 19.

Referring to FIG. 12, there is illustrated an exemplary embodiment of the illumination headgear 1200 in the form of a fabric military helmet cover 1201. Modern military helmets comprise of a durable crown-covering shell 1202 molded of bullet-resistant material such as Kevlar, over the exterior of which is disposed a camouflage patterned fabric cover 1201. The crown-covering shell 1202 may or may not be shaped in such a way as to have a forward projecting member comprising a brim 1208. A light source 1230 is integrally disposed along that part of a fabric helmet cover 1201 which when in place on the helmet shell 1202 places the light source along the forward rim 1210 of the brim 1208, or alternatively, considering a helmet designed without a brim 1208, at the forwardmost lower edge of the crown-covering shell 1202, in such a manner that when the helmet is being worn the light is focused forward to illuminate the area generally forward of the user, or in whatever direction the user is facing by turning the head. An electrical conducting path 1280 detachably coupled to itself at some point along its length by means of a two-component electrical connector 1287 is interiorly disposed to the helmet cover 1201 and connects to a power supply 1250 and switch 1266, demountably coupled to the interior of the fabric helmet cover by means of a two-component fastener 1287 such as hook and loop. When the fabric helmet cover 1201 is in place over the crown-covering shell 1202, the power supply 1250 and switch 1266 are disposed between the crown-covering shell 1202 and the fabric helmet cover 1201 with the switch 1266 facing outward, such that it can be conveniently manipulated through the flexible fabric helmet cover 1201. An advantage of this embodiment is that various colored LEDs may be used in the light source 1230 to fit specific military missions. Furthermore several LEDs with different light output characteristics may be mounted contiguously to comprise the whole of the light source 1230 such that different quality light output may be selected by means of a switch, in such a configuration as is illustrated in FIG. 19 and FIG. 20, to fit specific missions. For example white light may be employed for general purpose illumination; red light may be employed for illumination that preserves night vision; infrared light may be employed to extend the range of night vision equipment, to signal to others possessing infrared detection devices, and so on; ultraviolet light may be employed as a source of illumination to view materials printed with ultraviolet fluorescent ink, paint, and the like. Because infrared and ultraviolet light are not within in the visible spectrum, their use is less likely to betray one's position to an observer such as an enemy.

Figure 13:
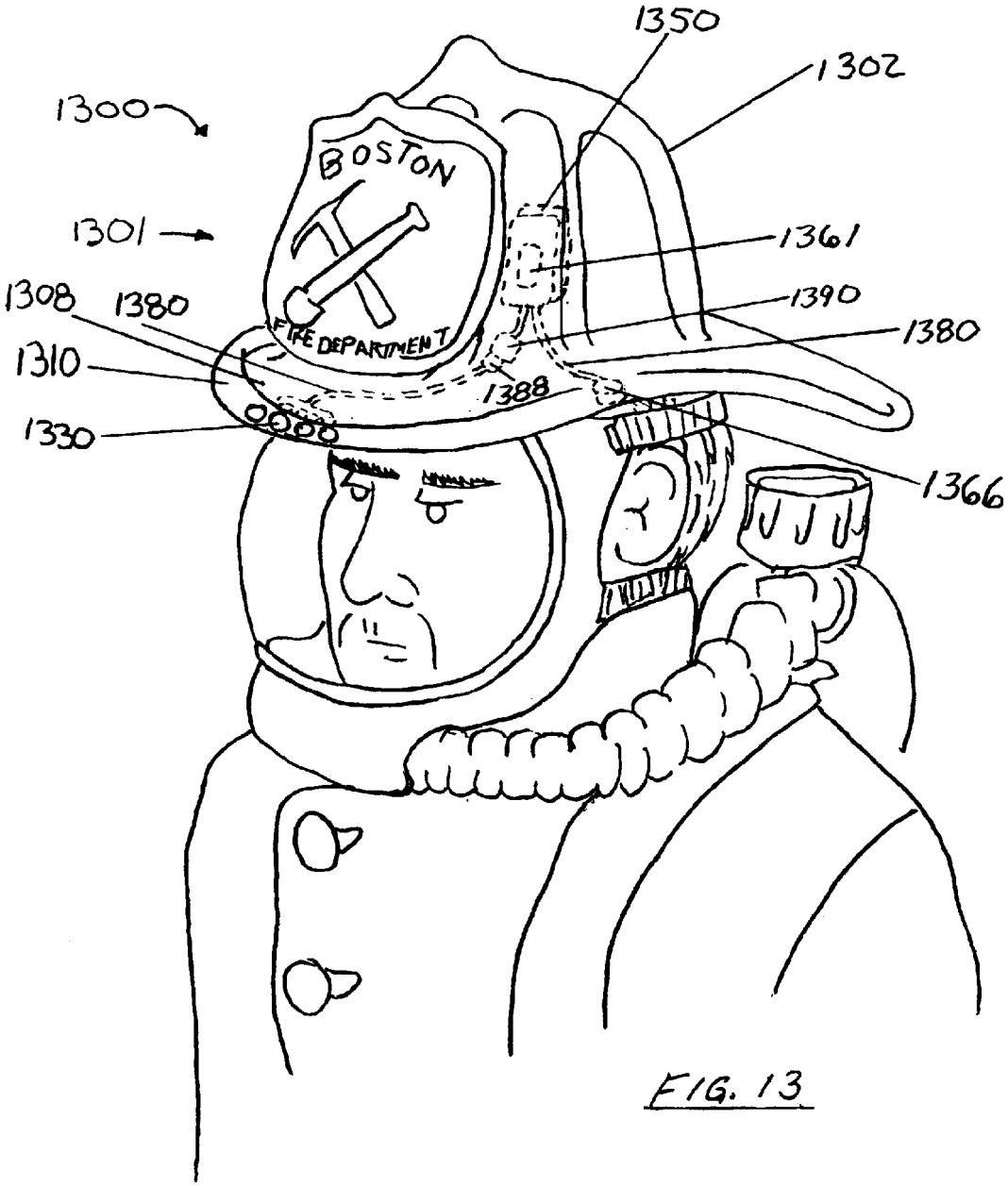
FIG. 13 is a perspective view of an exemplary embodiment of the illumination headgear in a firefighter's helmet.

Referring to FIG. 13 there is illustrated an exemplary embodiment of the illumination headgear 1301 as a firefighter's helmet 1310. A standard firefighter's helmet comprises a single piece molded construction in a shape that generally incorporates a crown covering portion 1302 and a protective brim 1308. A light source 1330 is integrally disposed interiorly to the brim 1308 along the forward portion of the rim 1310, directed forward to illuminate the area in front of the user, or the area toward which the user is facing by turning the head. An electrically conductive path 1380 is likewise interiorly disposed within the brim and the crown covering portion 1308 to a point of emergence within the interior space of the crown covering portion 1308 where it is terminated with an electrical connector 1388, such as a male plug. The light source 1330 and conductive path 1380 are incorporated into the molded shell comprising the headgear 1301 during its construction, in such a way as to preserve the necessary strength and integrity of the headgear 1301. A counterpart electrical connector 1390, such as a female plug, connects to an electrically conductive path 1380 which connects to a power supply 1350 detachably mounted interiorly to the crown covering portion 1302 by means of a fastener 1361, such as hook and loop, a clip and receptacle, or the like. A switch 1366 which controls the current flow between the power supply 1350 and the light source 1330 is connected to the power supply 1350 with an electrically conductive path 1380. The switch 1366 is detachably mounted at some position below the brim 1308 by means of a fastener, not shown, such as hook and loop, a clip, a bolt, a screw, or the like, such that it is easily reached and manipulated by the user. An advantage of this embodiment is that it gives a firefighter an illumination source that is durable, always present, and unencumbering, for entering darkened buildings, finding a route out of dark and smoky buildings, peering into darkened spaces, and so on. A further advantage for one who works in potentially combustible atmospheres, such as buildings with gas leaks, is the generally non-sparking nature of the of the circuitry supplying electrical current to the light source 1330. Because of the low voltage across the switch and low current drain of the light source, sparking due to mechanical switch bounce is minimized or eliminated. Furthermore breakage of the light source does not expose a hot filament, such as is inside a standard light bulb, to potentially combustible atmospheres.

Figure 14:
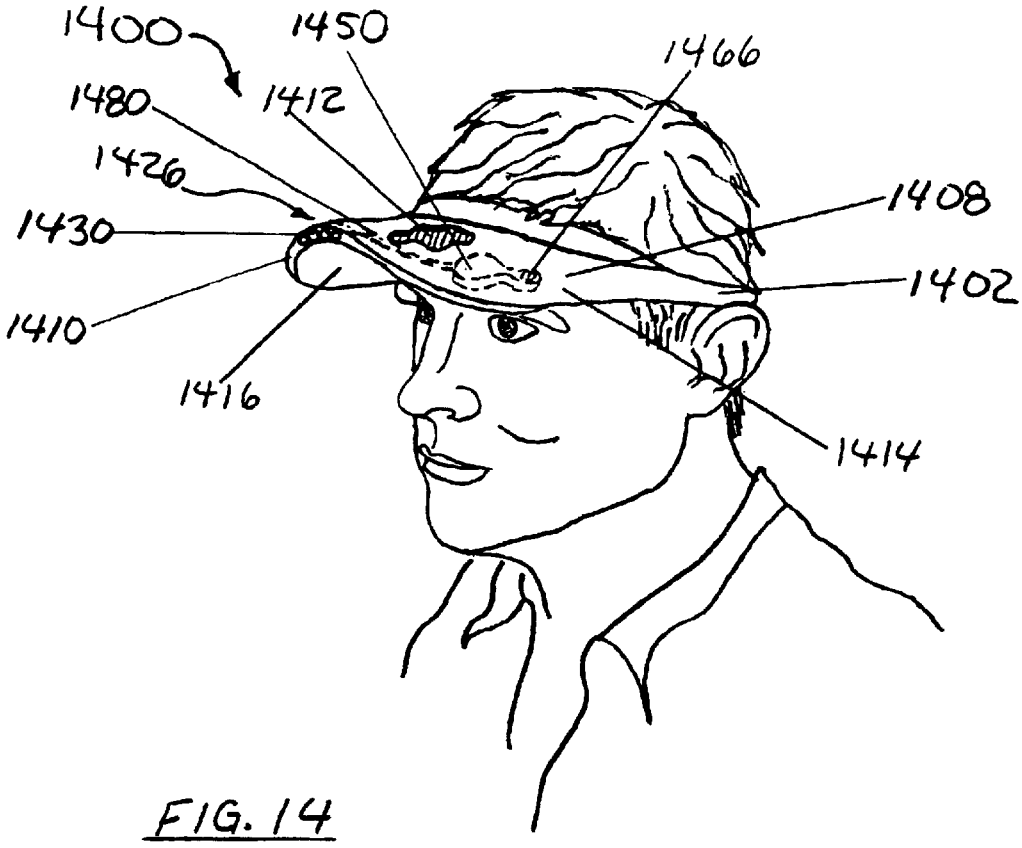
FIG. 14 is a perspective view of an exemplary embodiment of the illumination headgear in a visor.

Referring to FIG. 14, there is illustrated an exemplary embodiment of the illumination headgear 1400 in the form of a visor. The headgear generally comprises a band 1402 which fits circumferentially around the the user's head, leaving the top of the head exposed, along which band 1402 is exteriorly disposed a brim 1408 which projects forward from band 1402 from that portion most proximal to the user's forehead. A light source 1430 is integrally disposed along the rim 1410 of the brim 1408 so as to illuminate the area generally forward of the user, or the area toward which the user is facing by turning the head. The components which supply and control power to the light source 1430 are all disposed interiorly to the brim 1408 and may or may not be demountably coupled within the brim 1408 at the choice of the manufacturer. Specifically an electrical conducting path 1480 connects between the light source 1430 and a power supply 1450 and a switch 1466. The whole of the illuminating device 1426 comprising the light source 1430, the electrical conducting path 1480, the power supply 1450 and the switch 1466 are disposed within the main panel 1412 of the brim, between the top cover sheet 1414 and the bottom cover sheet 1416 of the brim. The switch 1466 is mechanically operated through the flexible material of the top cover sheet 1414 or bottom cover sheet 1416. These components may be molded into the main panel 1412 or otherwise disposed in voids within the main panel 1412 by means of adhesive, sewing, or the like. The use of miniature components that are approximately equal to or less than the main panel 1412 in thickness maintains the general shape of the brim 1408 and its aesthetic outward appearance. For example, coin-size batteries or smaller, such as watch batteries, may be employed in the power supply 1450. Examples of appropriately thin switches are a membrane switch, such as employed in calculators and other small electronic devices, or a low-profile slide-type switch. All of the components of the illuminating device 1426 may be permanently mounted within the brim 1408. The battery (not shown) within the power supply 1450 is the only component which may need to be removed for purposes of charging or replacement. Such removal can be permitted through a flap, a slot, or the like (not shown) in the bottom cover sheet 1416.

Figure 15:
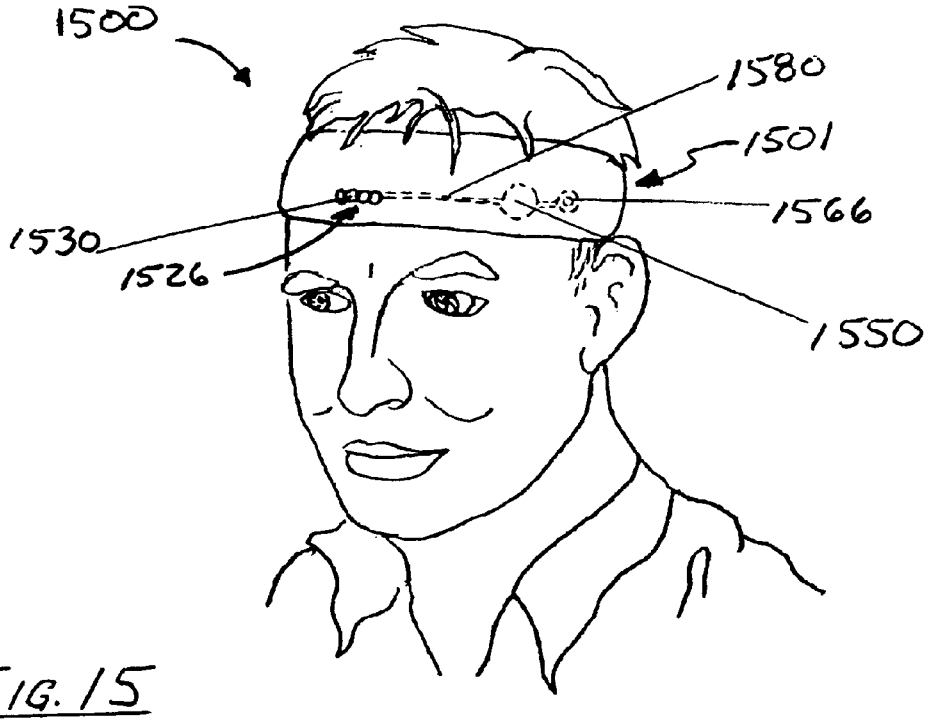
FIG. 15 is a perspective view of an exemplary embodiment of the illumination headgear in a headband.

Referring to FIG. 15 there is illustrated an exemplary embodiment of the illumination headgear 1500 as a headband, such as worn by joggers or others engaged in athletics. The headband headgear 1501 is comprised of a circularly shaped body of fabric which is worn around the forehead of the user. It may also be worn so as to cover the ears of the user for warmth. A common method of headband manufacture employs a tubular shaped piece of fabric sewn at the ends so as to make a circular body comprising two layers of fabric. In this embodiment an illuminating device 1526 is disposed between the two layers of fabric comprising the headband 1501 such that a light source 1530 is integrally disposed in that part of the headband worn most proximal to the forehead of the user, so as to illuminate the area forward of the user, or in the direction the user is facing by turning the head. In this disclosure the components of the illuminating device 1526 are illustrated separately and thusly: a light source 1530, an electrical conducting path 1580, a power supply 1550 and a switch 1566. All of these components are miniature in size such that they are lightweight and fit within the headband so as to preserve its general utility and aesthetics. For example using prior art components the LED(s) comprising the light source 1530 may be 10 mm or less in thickness from the forehead forward, a power supply 1550 employing watch batteries may be 5 mm or less in thickness, and a membrane switch or slide-type switch may be 3 mm or less in thickness. Further miniaturization of all components is feasible. Thus the components illustrated separately may be contained within a single miniaturized package, which package is disposed between the two layers of cloth comprising the headband 1501. The switch 1566 is manipulated by the user through the flexible fabric of the headband 1501. The battery (not shown) within the power supply 1550 is the only component which may need to be removed for purposes of charging or replacement. Such removal can be permitted through a flap, a slot, or the like (not shown) in the fabric comprising the headband 1501. Alternatively the entire illuminating device may be held in place within the body of the headband 1501 by means of a two component fastener, such as hook and loop (not shown), to permit complete removal of the illuminating device 1526 from within the headband 1501 through a slot or flap (not shown) so that the headband 1501 may be laundered without damaging the illuminating device 1526.

Figure 16:
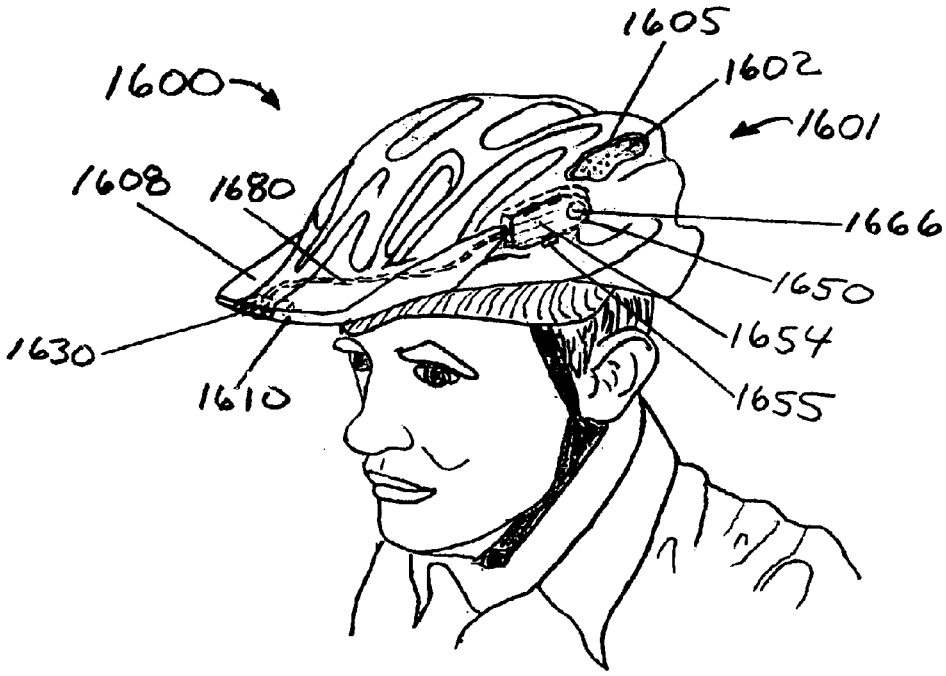
FIG. 16 is a perspective view of an exemplary embodiment of the illumination headgear in a sports helmet.

Referring to FIG. 16 there is illustrated an exemplary embodiment of the illumination headgear 1600 in the form of a protective sports helmet 1601, such as would be worn by a bicyclist, a roller skater, a skateboarder, or a person engaged in similar athletics. A common sports helmet 1601 generally comprises a crown-covering component 1602 made of molded styrofoam or the like, interiorly padded for comfort, and exteriorly covered by a durable plastic shell 1605. A brim 1608 extends forward from that part of the sports helmet 1601 worn most proximal to the user's forehead. A light source 1630 is integrally disposed along the rim 1610 of the brim 1608 so as to illuminate the area generally in front of the user or in the direction the user is facing by turning the head. An electrically conducting path 1680 is integrally disposed within the interior of the brim 1608, extending interiorly into the foam core of the crown covering component 1602, connecting to a power supply 1650 and switch 1666 integrally disposed interiorly to the foam core of the crown covering component 1602. The moveable portion of the switch 1666 is disposed directly interior to the plastic shell 1605, which is flexible where it covers the switch, such that the switch may be manipulated by pressing against that flexible portion of the plastic outer shell 1605. Alternatively a more flexible substance such as rubber, fabric, flexible plastic or the like may be incorporated into the outer shell 1605 directly covering the switch, to facilitate its use. Access to the interior of the power supply 1650 in order to remove and replace batteries is provided by a hinged cover 1654 which is held in a closed position by a latch or the like 1655.

Figure 17:
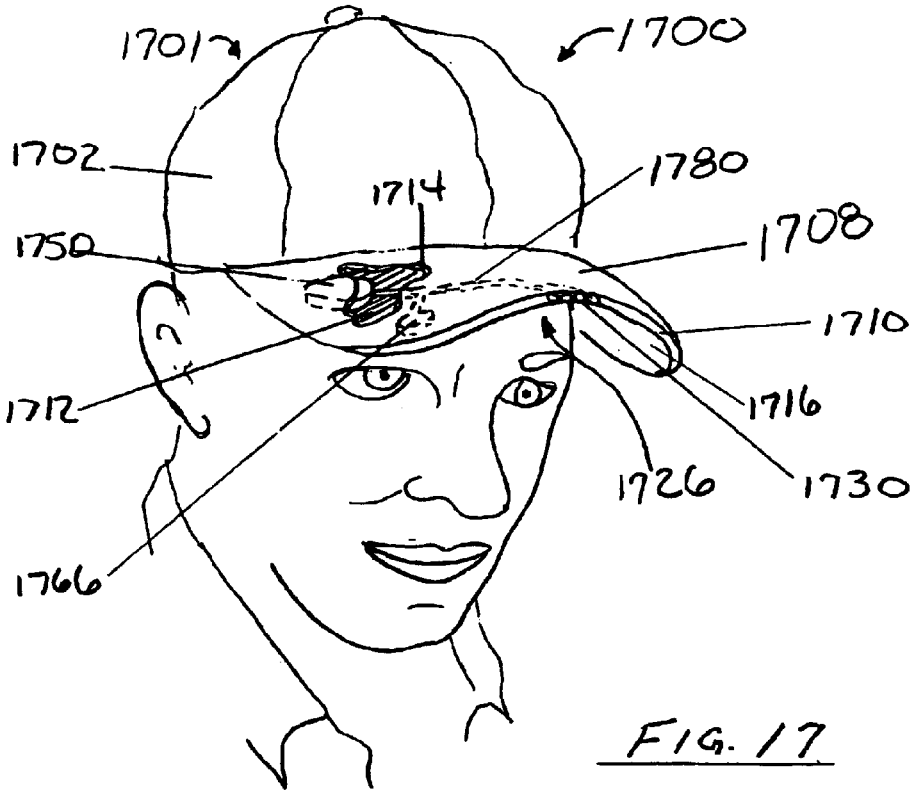
FIG. 17 is a perspective view of an exemplary embodiment of the illumination headgear in which all illuminating device components are mounted interiorly to the brim of the headgear.

Referring to FIG. 17 there is illustrated an exemplary embodiment of the illumination headgear 1700 in the form of a ball cap 1701, in which all of the components of the illuminating device 1726 are interiorly disposed within the brim 1708 of the ball cap 1701. The ball cap 1701 generally comprises a crown 1702 contoured for covering a part of the user's head when worn, a brim 1708 disposed exteriorly of and attached to the crown 1702 at a lower edge 1704 such that the brim 1708 extends outwardly from the crown 1702. A crown 1702 countoured to fit very closely against the head of the user may not have sufficient interior space to accommodate a power supply and switch as illustrated in FIG. 1. This embodiment demonstrates the use of miniature components which allow the illuminating device 1726 to be wholly within the brim 1708 of the ball cap 1701. A light source 1730 is integrally disposed along the rim 1710 of the brim 1708 so as to illuminate the area generally forward of the user, or the area toward which the user is facing by turning the head. The components which supply and control power to the light source 1730 are all disposed interiorly to the brim 1708 and may or may not be demountably coupled within the brim 1708 at the choice of the manufacturer. Specifically an electrical conducting path 1780 connects between the light source 1730 and a power supply 1750 and a switch 1766. The whole of the illuminating device 1726 comprising the light source 1730, the electrical conducting path 1780, the power supply 1750 and the switch 1766 are disposed within the main panel 1712 of the brim, between the top cover sheet 1714 and the bottom cover sheet 1716 of the brim. The switch 1766 is mechanically operated through the flexible material of the top cover sheet 1714 or bottom cover sheet 1716. These components may be molded into the main panel 1712 or otherwise disposed in voids within the main panel 1712 by means of adhesive, sewing, or the like. The use of miniature components that are approximately equal to or less than the main panel 1712 in thickness maintains the general shape of the brim 1708 and its aesthetic outward appearance. For example, coin-size batteries or smaller, such as watch batteries, may be employed in the power supply 1750. Examples of appropriately thin switches are a membrane switch, such as employed in calculators and other small electronic devices, or a low-profile slide-type switch. All of the components of the illuminating device 1726 may be permanently mounted within the brim 1708. The battery (not shown) within the power supply 1750 is the only component which may need to be removed for purposes of charging or replacement. Such removal can be permitted through a flap, a slot, or the like (not shown) in the bottom cover sheet 1716.

Figure 18:
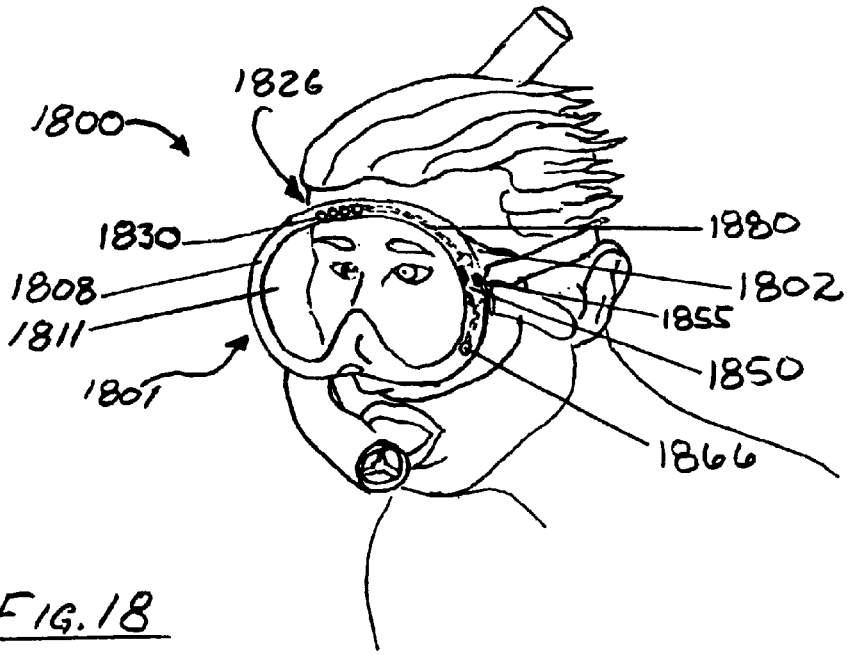
FIG. 18 is a perspective view of an exemplary embodiment of the illumination headgear in which the illuminating device is mounted in the forward leading edge of a diving mask.

Referring to FIG. 18 there is illustrated an exemplary embodiment of the illumination headgear 1800 in the form of a diving facemask 1801. A diving facemask 1801 generally comprises a body of rubber 1802 formed to conform to the forehead and cheekbones of the user so as to prevent water from entering, a plastic or rubber frame 1808 contiguously disposed at the edge of the body of rubber 1802 outermost from the face of the user, and a glass plate 1811 integrally mounted within the plastic or rubber frame 1808 in a watertight manner, the whole of which is more or less watertight so as to provide compartment of air around the eyes of the user to allow clear and undistorted seeing underwater. An illuminating device 1826 is incorporated into the diving facemask 1801, integrally disposed interiorly to the plastic or rubber frame 1808 which holds the glass plate 1811, generally by means of molding the components of the illumination device into the plastic or rubber frame 1808 during manufacture. A light source 1830 is integrally disposed at the forewardmost part of the facemask 1801 where it extends away from the forehead of the wearer, within the plastic or rubber frame 1808, such that it illuminates the area forward of the user, or in the direction that the user is facing by turning the head. The light source 1830 is connected to a power supply 1850 similarly molded within the frame 1808 by means of an electrical conducting path 1880. A switch 1866 similarly molded within the frame 1808 faces outwardly and is covered by a relatively flexible portion of the frame 1808 so that it may be manipulated by direct pressure against it. Access to the interior of the power supply 1850 in order to remove and replace batteries is provided by a hinged cover 1854 which is held in a closed position by a latch or the like 1855 in such a manner as to maintain a watertight compartment within the power supply 1850. An advantage of this embodiment is that it provides divers with a hands-free, readily available light source for night diving, deep diving, peering into dark areas and crevices, and so on, as part of their necessary equipment.

Referring to FIG. 19, there is illustrated an example of a light source 1930 comprising two sets of LEDs having different light output qualities, which can be electrically selected by means of a switch, such that only one set of LEDs is in use during a given time. In this example LEDs 1932 are two white LEDs electrically parallel to each other, and LEDs 1933 are two red LEDs electrically parallel to each other. Switch 1966 is a double pole, double throw switch which selects between either the white LEDs 1932 or the red LEDs 1933 or the OFF state. Using this method of differentially selecting LEDs of different qualities, any number of different types of LEDs may be combined in an array comprising a single light source 1930 from which different qualities of light may be selected by the user for different purposes, by multiplying the number of LEDs with different light qualities, and correspondingly multiplying the number of switch contacts to select each separate quality of light. One exemplary advantage of using an illumination headgear employing such a differentially selectable light source would be to an aircraft pilot, flying at night, who is under legal constraint to carry a flashlight, and under a practical constraint to preserve his night vision. An illumination headgear incorporating a light source which allows switching between two qualities of light satisfies both constraints. For example in the event of a power outage the red light source can be switched on for seeing instruments in the cockpit while preserving night vision necessary for seeing during an emergency landing. If white light is required for purposes such as examining a map, or examining the wings for icing, the white LED array may be switched on. Additional advantages of using an illumination headgear with differentially selectable light sources are illustrated in FIG. 21 and FIG. 22.

Referring to FIG. 20 there is illustrated a circuit schematic representing the electrical configuration of the light source illustrated in FIG. 19. Switch 2066 is OFF in position 1, turns on LED array 2032 in position 2, and turns on LED array 2033 in position 3.

Figure 21:
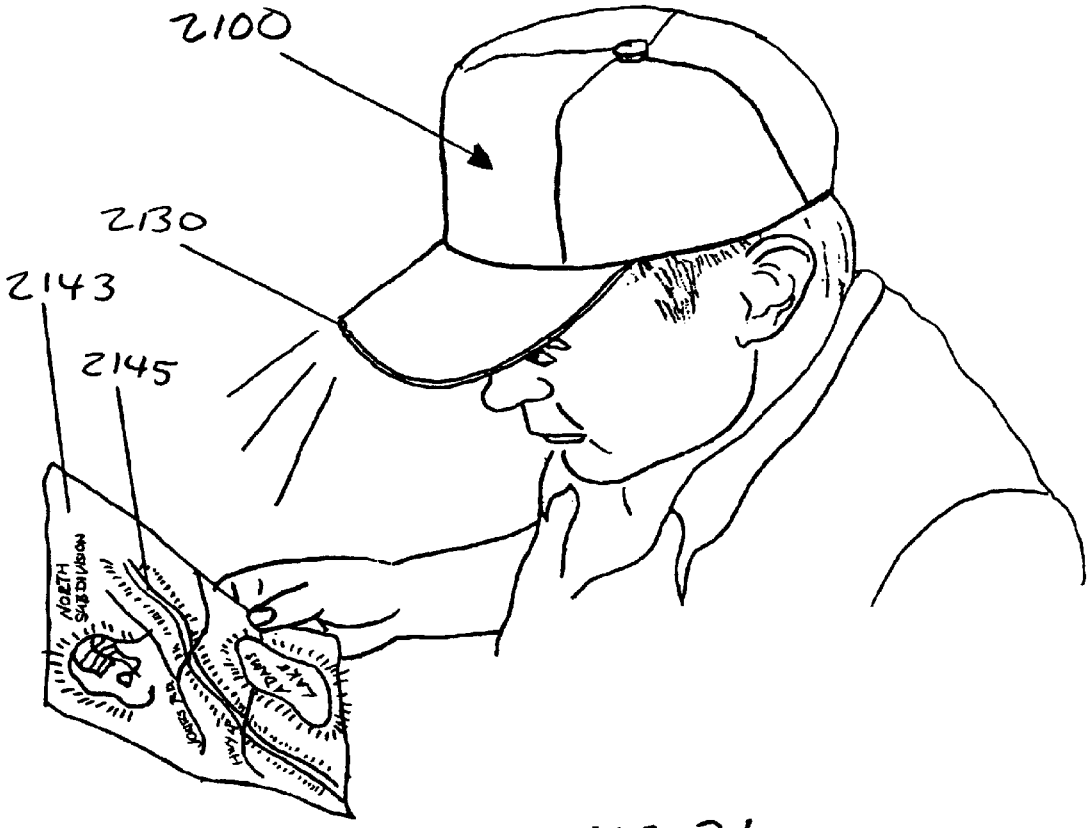
FIG. 21 is a perspective view of an embodiment of the illumination headgear incorporating the light source depicted in FIGS. 19, 20 showing a use of ultraviolet LEDs for reading a publication incorporating ultraviolet fluorescent ink or paper.

Referring to FIG. 21 there is illustrated a use of an illumination headgear 2100 having a light source 2130 with differentially selectable qualities of light. The user being outdoors at night may generally employ white LEDs for general purpose illumination. In this figure the user is alternatively employing ultraviolet LEDs for reading printed material 2143 which employs ultraviolet fluorescent ink 2145. An advantage of employing ultraviolet light in this manner is that it is not in the visible spectrum, so the user is not displaying a light which might be seen by other people or by animals thus giving away his presence or position.

Figure 22:
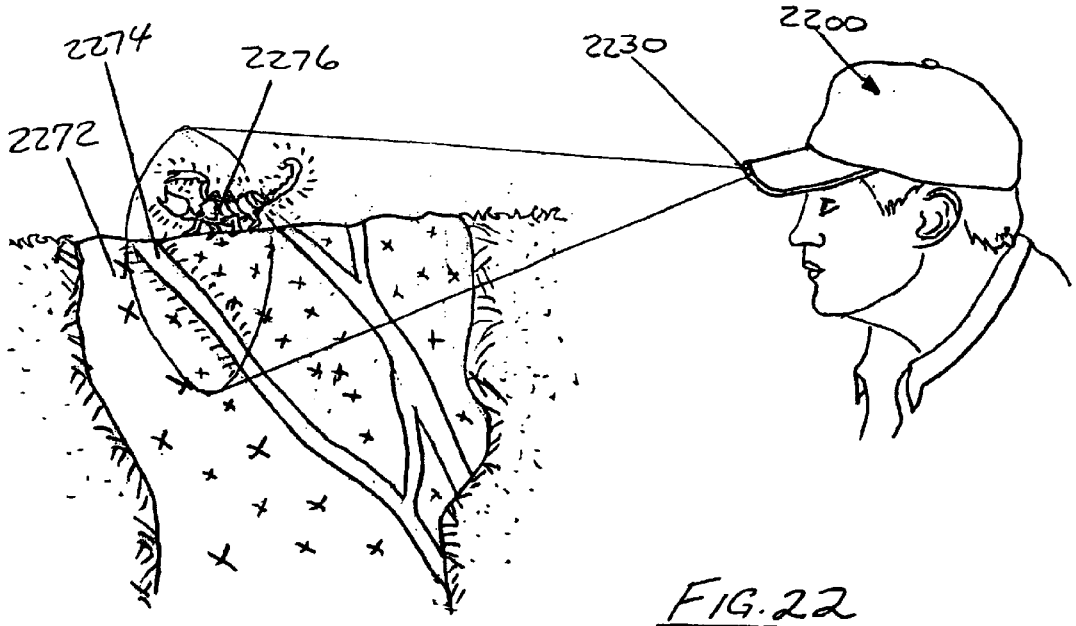
FIG. 22 is a side elevation view of an embodiment of the illumination headgear illustrating a use of ultraviolet LEDs for detecting ultraviolet fluorescent minerals and ultraviolet fluorescent creatures.

Referring to FIG. 22 there is illustrated another advantage of using an illumination headgear 2200 having differentially selectable qualities of light. The user being outdoors at night may generally employ white LEDs for general purpose illumination. In FIG. 22 the user is alternatively employing ultraviolet LEDs 2230 to discern veins in a rock outcrop 2272 containing ultraviolet fluorescent minerals 2274, such as scheelite, willemite, zincite, some forms of calcite and fluorite, and the like. The user is also able to see ultraviolet fluorescent creatures such as scorpions 2276. In the same manner, the user may employ ultraviolet light for observing organic compounds which fluoresce under UV, such as various naturally occurring compounds, the commonly used stain fluorescine, and the like (not shown).

Figure 23:
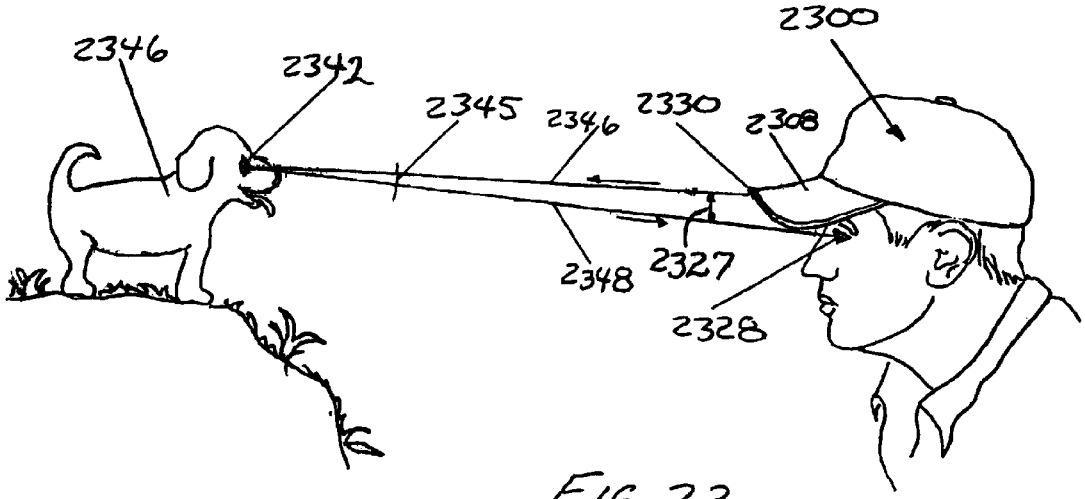
FIG. 23 is a side elevation view of an embodiment of the illumination headgear illustrating its use as a means for detecting animals in the dark.

Referring to FIG. 23 there is illustrated a method of employing the illumination headgear 2300 for finding animals in the dark by seeing the reflection of light from their eyes. This method takes advantage of the fact that the retina at the back of most creatures' eyes is very reflective, and the small vertical distance 2327 between the light source 2330 of the illumination headgear 2300, and the eye of the user 2328. As this distance 2327 can be quite small, say an inch, more or less, and can be adjusted by moving the brim 2308, to approximately zero, the angle of reflection 2345 between a ray of light from the source 2346 and a ray of light reflected back 2348 from the eye 2342 of the creature 2346 is some very small angle, for example one or three degrees. Because of the geometry of the eye, as the angle of reflection 2345 becomes smaller and approaches zero, the reflected light from the retina of the creature 2346 appears brighter. This method of finding creatures in the dark is enhanced by a natural habit of many creatures to turn and face toward a light source. This method of employing an illumination headgear to find animals in the dark may be used to find spiders, scorpions, dogs, deer and birds that might otherwise escape detection if a handheld flashlight were employed.

The illumination headgear is a conventional headgear having an integral illumination device to provide the user general purpose illumination that is hands free, unobtrusive, durable, and conveniently available, having a light source in the forward structure of a headgear directed forward to illuminate the area generally forward of the user, or in whatever direction the user is facing by turning the head. The headgear generally has a forward projecting brim in which the light source is integrally disposed within the forward directed rim of the brim. The light source essentially comprises one or more high intensity light emitting-diodes (LEDs). The LEDs arc electrically connected to a power source mounted interiorly to the headgear. A means for controlling the on or off state of the LEDs and the amount of electrical current they receive is provided in the form of a switch or an electronic circuit.

The novel features that are considered characteristic of the illumination headgear are set forth with particularity in the appended claims. The illumination headgear itself, however, both as to its structure and its operation together with the additional advantage and advantages thereof will best be understood from the following description of the preferred embodiment of the illumination headgear when read in conjunction with the accompanying drawings An advantage of the illumination headgear is to provide a miniaturized high intensity illumination source, power source and control means that can fit within the structure of a headgear which has its own intrinsic utility and aesthetic appearance in such a way as to add the utility of hands free illumination for seeing in dark places while preserving the overall aesthetic appearance and utility of the headgear.

It is still another advantage of the illumination headgear to provide a source of forward directed illumination that can be incorporated into a variety of specialized headgear to enhance the intended utility of such specialized headgear by adding an illumination source for the benefit of the user.

It is another advantage of the illumination headgear that the utility of an illumination device is always readily available when the headgear is worn, rather than being capable of being forgotten or left behind, or being carried on one's person in an inconvenient place.

It is another advantage of the illumination headgear to provide portable illumination that is automatically directed along the user's line of sight by movement of the user's head.

It is another advantage of the illumination headgear that the angle at which the illumination is projected forward may be adjusted by adjusting the position of the headgear on the head.

It is another advantage of the illumination headgear to provide a robust and reliable source of portable illumination that would not easily break or fail.

It is still another advantage of the illumination headgear to provide a portable illumination source that would not need a shield to prevent unwanted glare from the illumination source that could impair the user's vision.

It is still another advantage of the illumination headgear to provide a portable illumination source that can vary the intensity of the light and conserve the power source by using electronic circuitry providing intermittent power to the LEDs (i.e. strobing the LEDs) at a rate that would be perceived as essentially steady, unbroken illumination to the human eye (e.g. 20 Hz or greater).

It is still another advantage of the illumination headgear to provide a means for detecting animals, insects, arachnids or other creatures in the dark by providing a source of light that is worn very close to the eyes of the user such that the light reflecting back from the eyes of the creature being observed is at a very small angle of reflection thus reflecting light from the retina of the creature's eyes back to the user.

It is still another advantage of the illumination headgear to provide a hands free portable source of illumination in different portions of the color spectrum for special purposes of the user.

It is still another advantage of the illumination headgear that the methods of integrating an illumination device into specific headgear are generally consistent with the methods of manufacture of the headgear, e.g. the illumination device may be molded into a molded headgear, sewn in place in a fabric headgear, woven into a felt headgear, and so on.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. An illumination headgear for viewing objects comprising:

a crown having a lower edge;

a brim disposed on said crown proximate to said lower edge, said brim having a rim disposed along the perimeter of said brim distal from said lower edge; and an array of contiguous light emitting diodes integral within said brim and proximate to said rim, said array of contiguous light emitting diodes focused to form a contiguous beam.

2. The illumination device of claim 1 wherein said light emitting diodes are coupled to a power source through a switch.

3. The illumination device of claim 1 wherein said brim includes a main panel having a top covering disposed over an upper surface thereof and a lower covering disposed over a lower surface thereof and said array of contiguous light emitting diodes is disposed between said top covering and said main panel at said rim.

4. The illumination device of claim 1 wherein said brim includes a main panel and a top covering disposed over an upper surface thereof and a lower covering disposed over a lower surface thereof and said array of contiguous light emitting diodes is disposed between said lower covering and said main panel at said rim.

5. The illumination device of claim 2 wherein said power source is located within said crown.

6. The illumination device of claim 1 wherein said array of light emitting diodes is disposed proximate to said rim and flush with said rim.

7. The illumination device of claim 1 wherein said array of light emitting diodes is disposed proximate to said rim and protrudes beyond said rim.

8. The illumination device of claim 1 wherein said array of light emitting diodes is disposed proximate to said rim and is recessed in said rim.

9. The illumination device of claim 1 wherein said array of light emitting diodes includes at least one separately controlled light emitting diode to illuminate said object.

10. The illumination device of claim 1 wherein at least one light emitting diode of said array of light emitting diodes is selected from the group consisting of white light, red light, blue light, green light, yellow light, infrared light and ultraviolet light.

11. The illumination device of claim 1 wherein said array of light emitting diodes is coupled to an energy conserving circuit.

12. The illumination device of claim 2 wherein said power source is encased in a moisture tight case demountably coupled to said crown.

13. The illumination device of claim 1 wherein said headgear is selected from the group consisting of a ball cap, a hardhat, a firefighter helmet, a jungle hat, a military helmet cover and a sports helmet.

14. An illumination headgear for viewing objects comprising:

a headgear including a crown having a lower edge coupled to a brim extending distally from said crown, said brim having a base defining the perimeter of said brim coupled to said lower edge and a rim along a perimeter of said brim distal from said base;

a power source demountably coupled to said crown; and at least one light emitting diode configured to form a single non-segmented beam to illuminate objects in an area, said at least one light emitting diode disposed integral within said brim at said rim of said headgear.

15. The illumination device of claim 14 wherein said at least one light emitting diode is controlled to vary the single non-segmented beam to illuminate said objects in an area.

16. The illumination device of claim 14 wherein said headgear is selected from the group consisting of a ball cap, a hardhat, a firefighter helmet, a jungle hat, a military helmet cover and a sports helmet.

17. The illumination device of claim 14 wherein said at least one light emitting diode is demountably coupled to said headgear.

18. The illumination device of claim 14 wherein said at least one light emitting diode is coupled to a multi-switch.

19. An illumination headgear for viewing objects comprising:

a headgear having a headband configured to encircle a wearers head, a brim coupled to said headband located proximate to said wearers forehead; and an array of contiguous light emitting diodes integral with said brim, said array of contiguous light emitting diodes configured to form a contiguous beam to illuminate an object.

20. The illumination device of claim 19 wherein said headgear is a visor.

21. The illumination device of claim 19 wherein said headgear is a diving mask.

22. A method of using an illumination headgear comprising:

mounting the illumination headgear to a wearers head, said illumination headgear including a brim proximate to said wearers forehead and a light source integral within said brim at a rim of said brim, said light source including at least one array of contiguous light emitting diodes configured to form a contiguous beam to illuminate an object;

activating said at least one light emitting diode of said array of contiguous light emitting diodes;

directing said contiguous beam emitted from said array of contiguous light emitting diodes toward an object to be viewed.

23. The method of using an illumination headgear of claim 22 wherein at least one of said light emitting diodes is an ultraviolet light.

24. The method of using an illumination headgear of claim 22 further comprising:

directing ultraviolet light emitted from said light source toward an object that fluoresces with exposure to ultraviolet light;

observing said fluorescence.

25. The method of using an illumination headgear of claim 24 wherein said object that fluoresces includes indications on a printed matter.

26. The method of using an illumination headgear of claim 24 wherein said object that fluoresces is a creature.

27. The method of using an illumination headgear of claim 24 wherein said object that fluoresces is a mineral.

28. The method of using an illumination headgear of claim 24 wherein said object that fluoresces is a chemical compound.

29. The method of using an illumination headgear of claim 22 wherein said object to be viewed is a creature.

30. The method of using an illumination headgear of claim 29 further comprising:

directing said contiguous beam emitted from said array of contiguous light emitting diodes at said creature.

31. The method of using an illumination headgear of claim 30 further comprising:

adjusting an angle of reflection from about zero degrees to about three degrees, said angle of reflection including the angle between a ray of light from said array of contiguous light emitting diodes and a ray of light reflected back from an eye of said creature.

* * * * *